US005476706A

United States Patent [19]

Shimizu

[11] Patent Number: 5,476,706

[45] Date of Patent: Dec. 19, 1995

[54] SPORTING IMPLEMENT HAVING A HEAD PORTION WITH A HITTING SURFACE FOR CONTACTING A BALL

[76] Inventor: Okiyoshi Shimizu, 5-21-4-404, Higashigotanda, Shinagawa-ku, Tokyo, Japan

[21] Appl. No.: 150,300

[22] Filed: Nov. 12, 1993

[30] Foreign Application Priority Data

Nov. 16, 1992 [JP] Japan ..... 4-329983
Oct. 19, 1993 [JP] Japan ..... 5-260673

[51] Int. Cl.[6] ..... A63B 59/06; A63B 53/04

[52] U.S. Cl. ..... 428/136; 428/137; 428/473; 428/904; 273/72 R; 273/78

[58] Field of Search ..... 428/136, 137, 428/473, 904; 273/72 R, 78

[56] References Cited

U.S. PATENT DOCUMENTS 3,764,137 10/1973 Petro ..... 273/77 R
4,534,558 8/1985 Yoneyama ..... 273/78
4,929,483 5/1990 Hälg et al. ..... 428/47

FOREIGN PATENT DOCUMENTS 3-236866 10/1991 Japan .

*Primary Examiner*—William P. Watkins, III
*Attorney, Agent, or Firm*—Lowe, Price, LeBlanc & Becker

[57] ABSTRACT

A sporting implement has a head portion with a hitting surface for contacting a ball. The implement uses a plurality of animal hide sections formed in a laminate for excellent durability, elasticity, batting sound and batting field. Each of the animal hide sections have a plurality of slits therein. The head portion or club head of the sporting implement is profiled so that the laminated end surfaces of the laminated hide are directed at a hitting or batting surface, whereby a stress generated in the batting surface at the time of batting is absorbed and attenuated by the plurality of slits within the laminated hide surface.

11 Claims, 5 Drawing Sheets

SPORTING IMPLEMENT HAVING A HEAD PORTION WITH A HITTING SURFACE FOR CONTACTING A BALL

BACKGROUND OF THE INVENTION

1. Field of the Invention

The present invention relates to sporting goods for batting including a golf club, a base ball bat, cricket and others formed with a batting portion making use of hides of cattle, horses and other suitable animals.

2. Description of the Prior Art

A conventional golf club will be described. For a club head of a wood club, persimmon which is one kind of a Japanese persimmon tree, metal, carbon or the like have been used. The club head made of metal, carbon or the like excels in flying distance to that made of persimmon but is inferior thereto in batting sound, batting feeling and batting stability. In the present situation, even the club head made of persimmon is insufficient in hardness as compared with a ball which is made to increase hardness and enhance elasticity in order to extend a flying distance, thus failing to make the best use of elasticity of the ball.

Taking into account the problem as noted above, there is disclosed (in Japanese Patent Laid-Open Publication No. 3-236866) a golf club of which club head formed by laminating hides of cattle, horses and other suitable animals in order to provide a golf club having a club head which can exhibit both merits of persimmon, and metal, carbon, etc. even for a ball having a high hardness and having a high class feeling.

This golf club is excellent in the beauty of external appearance, batting sound and batting feeling. The hardness of the head according to this golf club is somewhat lower than that of a metal head but is substantially approximate to that of carbon and is higher than that of persimmon. Therefore, the flying distance can extend more than that in case of persimmon even with respect to a ball having a high hardness. However, it has been found that such a golf club as described has a problem in terms of durability Such that as the golf club is used for a long period, the hide fibrous tissue of a side opposite to the batting surface, a neck portion or an end of a head portion of the club head subjected to the batting and shock gradually gets out of shape.

SUMMARY OF THE INVENTION

Turning attention to the problem as described above, the cause thereof has been pursued. As a result, the problem was judged to be the concentration of the batting stress on the aforementioned respective ends. Further, it occurred to mind that if a batting portion of a base ball bat, a tennis racket or cricket having a batting portion similar to a golf club head is formed by laminating hides, the goods excellent in hardness and batting feeling can be produced.

Accordingly, sporting goods for batting according to the present invention is characterized by having a batting portion formed by compressing and hardening a hide provided with a plurality of slits or characterized by having a batting portion formed by a laminated hide obtained by laminating hides provided with a plurality of slits and compressing and hardening the same.

Preferably, a longitudinal direction of the slits is generally parallel to a hitting surface of the batting or head portion of the sporting implement. When the head portion is a golf club head, it is preferred to have the plurality of animal hide sections inclined to a plane perpendicularly intersecting the hitting surface.

When the head portion is the barrel portion of a baseball bat, it is preferred to have a laminate aligned with a longitudinal axis of the barrel portion. In a further embodiment, the plurality of animal hide sections are laminated so that slits of one animal hide section are misaligned with slits of an adjacent animal hide section. The laminate can also be arranged in a radial fashion with respect to the axis of the barrel portion so that end portions of the laminate form the hitting surface.

With such sporting goods for batting, a stress generated in a batting portion at the time of batting is absorbed and damped in the plurality of slits within the laminated hide surface to enable the weakening of stress generated in the laminated hide end portion.

Further, preferably, it is formed that the laminated end surface of the laminated hides is directed at the batting surface and the slits intersect in the batting direction. With this formation, the hardness can be further increased while maintaining the elasticity, batting sound, batting feeling and durability.

More preferably, the slits are formed so that the batting direction of the batting surface positively intersects either one of slits formed in plural row. With this formation, sporting goods for batting having a higher durability can be obtained.

DETAILED DESCRIPTION OF THE INVENTION

Embodiments according to the present invention will be described hereinbelow with reference to the drawings.

Figure 1:
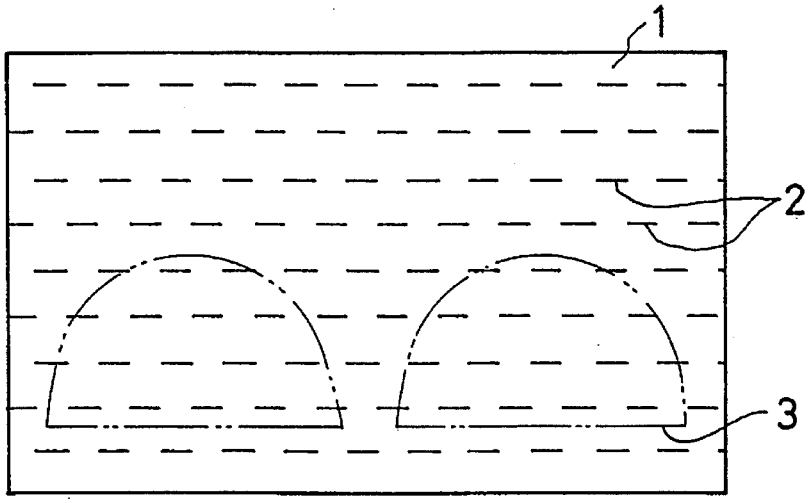
FIG. 1 is a plan view showing a processing state of a golf club head by a laminated hide according to the present invention.

In FIGS. 1, 2, 4 and 5, a hide 1 according to the present invention is obtained by hides of cattle, horses and other animals, preferably thick and tough hides of animals, for example, processing the true skin layer. A plurality of slits 2 are discontinuously formed over the whole surface of thee hide as shown in FIG. 1. Then, each hide 1 is suitably impregnated with a hardener. A plurality of hides are then laminated through suitable adhesives, heated and pressed to be compressed and hardened to form a laminated hide having a sufficient hardness.

Figure 2:
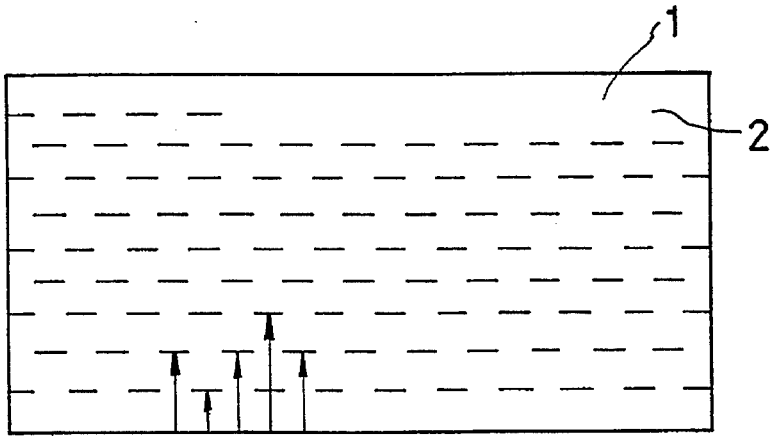
FIG. 2 is an enlarged partial plan view showing one example of an arrangement state of slits.

The slits 2 have a suitable length, for example, about 10 mm to about 15 mm. The slits 2 are arranged as follows. For example, as shown in FIG. 2, a plurality of rows of slits arranged discontinuously and in parallel are formed and disposed so that a stress substantially perpendicularly intersecting with respect to the slits 2 generated at the time of batting positively crosses with one or more slits out of a plurality of rows of slits 2.

Figure 3:
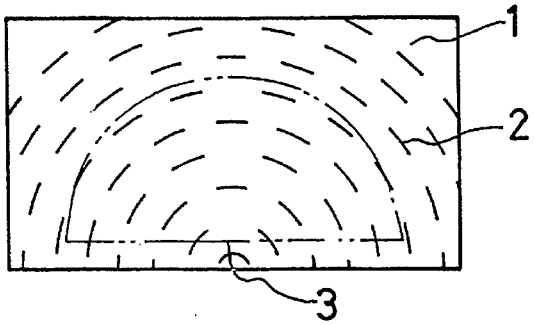
FIG. 3 is a plan view showing a further example of an arrangement state of slits.

It is to be noted that the slits 2 may be arranged at suitable intervals in the form of a coaxial circle about a batting surface portion 3 of a club head which constitutes a batting portion, as shown in FIG. 3.

The impregnation and coating of the above-described hardener and adhesives can be carried out in accordance with a conventional hide processing method. In the state of laminated hide, the slits 2 are impregnated with the hardener and adhesvies.

It is desired in the heating and pressing that pressing is effected perpendicularly intersecting with respect to the surface of a laminated hide 4.

The laminated hide 4 is heated and pressed to be compressed. The laminated hide 4 is then dried and hardened by a drying device with hot air having a temperature of approximately 35° to 60° C. for a whole day and night to form a laminated hide having a sufficient hardness. If a hot-air drying temperature is excessively high, the hide is deteriorated. Therefore, the excessively high temperature is not preferred.

Non-heating and pressing can be employed in place of the aforesaid heating and pressing. In this case, natural drying can be employed in place of the hot-air drying. Preferably, the drying is progressed while suppressing the chemical reaction. Therefore, the natural drying within a dark room is suggested, in which case the hide is left a whole day and night or so in an environment at room temperature for example, about 20° C.

Whichever method may be employed, water content is lowered from the state of 100% down to about 5% to about 10%.

The laminated hide 4 may have a suitable size, and a suitable number thereof may be used. For example, it is preferred that the laminated hide 4 be formed capable of being subdivided into unit blocks of the same number as that of club heads 5 according to the present invention, from which unit blocks a plurality of club heads 5 can be profiled by means of copying.

The profiling of the club head 5 from the laminated hide 4 is carried out so that the end surface of the laminated layer is directed at a batting surface 6 and the slits 2 intersect substantially perpendicularly in a batting direction.

Figure 4:
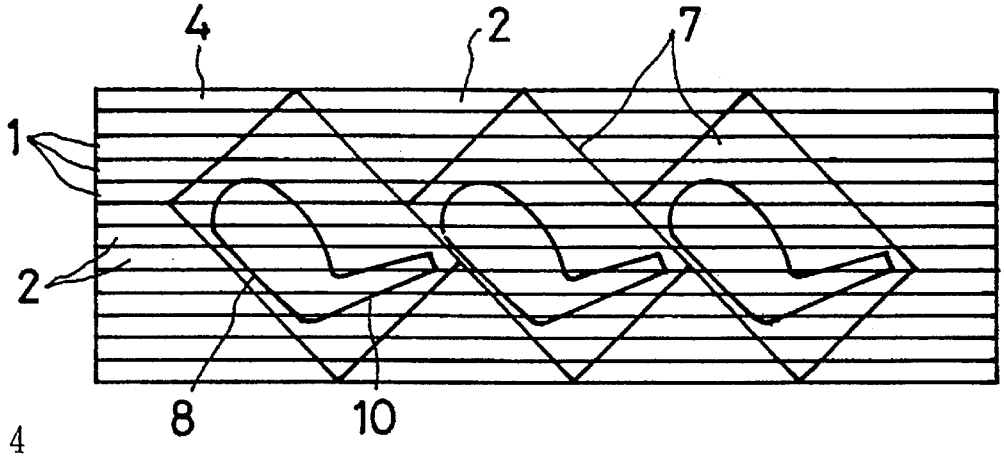
FIG. 4 is a front view showing a processing state of a golf club head by a laminated hide according to the present invention.
Figure 5:
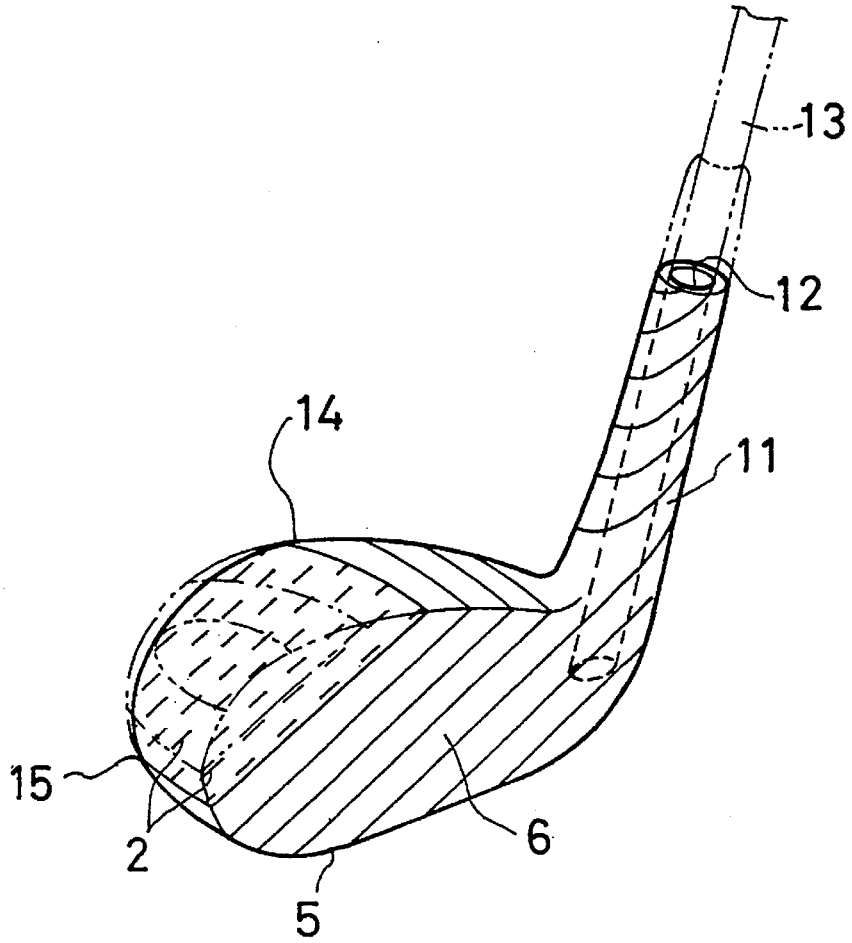
FIG. 5 is a partly cutaway perspective view of a club head produced according to FIG. 1 and FIG. 4.

One method of producing a golf club will be described. As shown in FIG. 4 and FIG. 5, a plurality of unit blocks 7 for forming club heads 5 from the laminated hide 4 are profiled. Each unit block 7 is subjected to copying to form a club head 5 in which a direction of laminated surface 10 is risen and inclined by approximately 45 degrees (this angle is voluntary) toward a neck portion 11 side with respect to a sole surface 8, so that the direction of laminated layer 10 of the laminated hide 4 is risen and inclined toward the neck portion 11 side with respect to the sole surface 8 of the club head 5. Subsequently, a shaft insert hole 12 is formed in the neck portion 11, surface of which is suitably finished. Preferably, a face plate or a sole plate is fixedly mounted, and a shaft 13 is inserted and bonded by an adhesive to provide a golf club 5.

Alternatively, although not shown, the hide is integrally coated along the club head surface other than the batting surface to form a club head 5 having the external appearance in which the hide surface appears on the surface.

Figure 6:
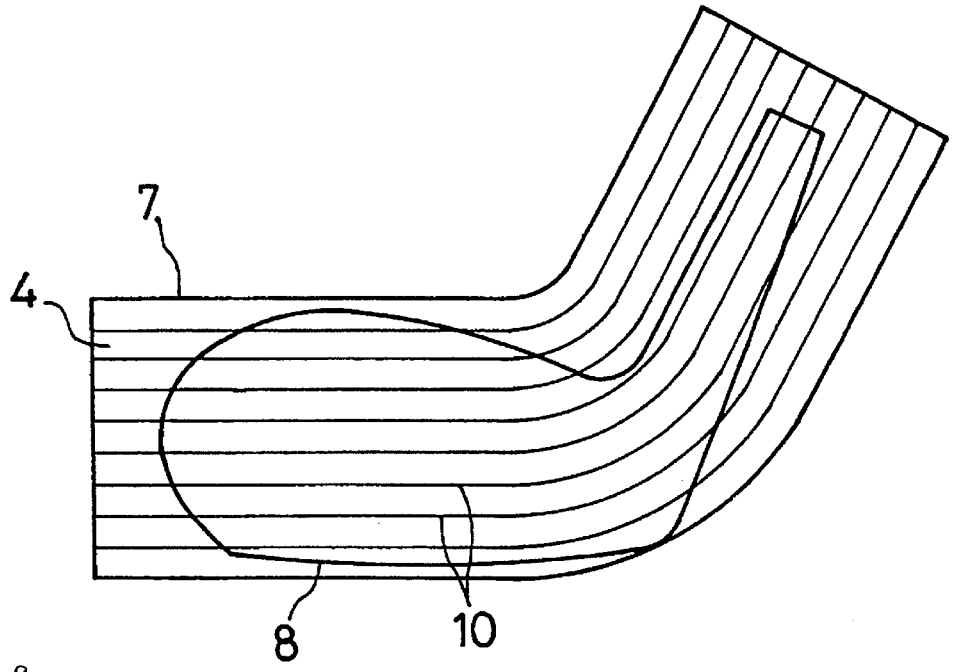
FIG. 6 is a front view of a processing state showing a method for producing a club head according to the another embodiment of the present invention.
Figure 7:
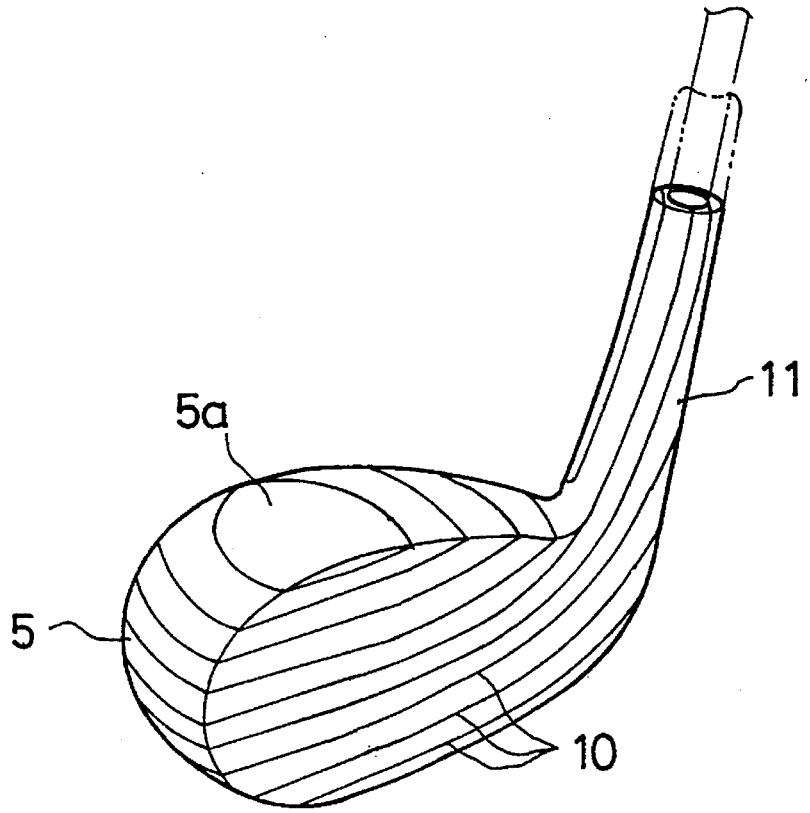
FIG. 7 is a perspective view of a club head produced according to FIG. 6.

Furthermore, as shown in FIG. 6 and FIG. 7, a neck portion 11 can be bended with respect to a head portion 5*a* so that when a unit block 7 of the laminated hide 4 is heated and compressed, the direction of a laminated surface 10 of a portion corresponding to the head portion 5*a* is substantially parallel with a sole surface 8 and the surface of a laminated surface 10 of a portion corresponding to the neck portion 11 is substantially parallel with the shaft direction. Accordingly, one and the same hide continuously extends from the head portion 5*a* to the end of the neck portion 11, and a shaft insert hole 12 can be formed within the continuous hide.

According to the above-described club head 5, the stress and shock-vibrations applied to the batting surface 6 at the time of batting are generated substantially in the direction opposite to the batting and simultaneously absorbed and attenuated while perpendicularly intersecting with a plurality of silts 2 provided in each laminated hide 1 to materially Weaken the stress concentrated on an edge portion 14 opposite to the head 5*a*, a neck portion 11, a head portion 15 and the like, thus remarkably enhancing the durability of the club head 5.

Moreover, the hardness of the club head is further increased by the hardener and adhesives impregnated in the slits 2. For example, the flying distance for even a ball having a high hardness can be further extended, and a clearer batting sound can be created. This is conspicuous as compared with the case where no slit is provided.

Incidentally, a difference in hardness from that of a head formed of other material or not provided with slit is compared by experiments. As a result, it was found that when the hardness of carbon material is 100, that of metal material is about 120; that of persimmon is about 65; that of hide material(without slit) is about 70; and that of hide material (with slits) is about 85 to 95.

Further, as compared with a club head without slits, a club head 5 with a plurality of slits 2 can be light-weighted.

Figure 8:
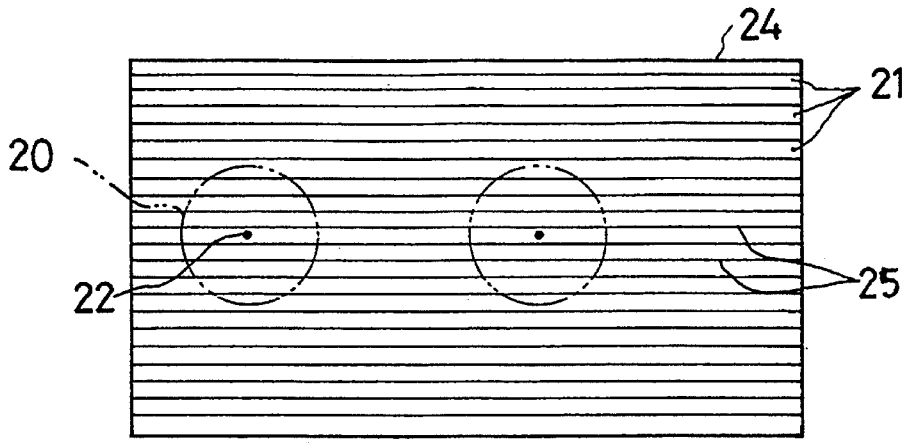
FIG. 8 is a sectional view according to a processing state in which a base-ball bat is formed by a laminated hide according to the present invention.
Figure 9:
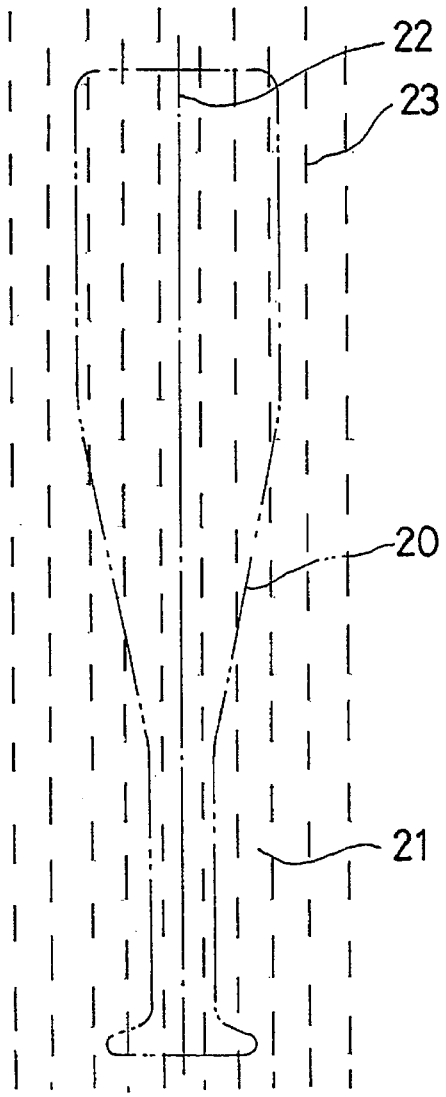
FIG. 9 is a cross sectional view of FIG. 8.

FIG. 8 and FIG. 9 show a base-ball bat 20 according to the present invention.

The base-ball bat 20 is formed by profiling in a manner such that a center axis 22 of the bat 20 is substantially parallel with a direction of a laminated surface 25 and a direction of a slit 23.

The method for producing the base-ball bat 20 will be described. For example, a laminated hide 24 is formed from hides 21 similarly to the above-described laminated hide 4. A plurality of unit blocks used to form a base-ball bat are profiled from the laminated hide 24. Each unit block is subjected to copying so that the center axis 22 is substantially parallel with the direction of a laminated surface 25 and the direction of slit 23.

Figure 10:
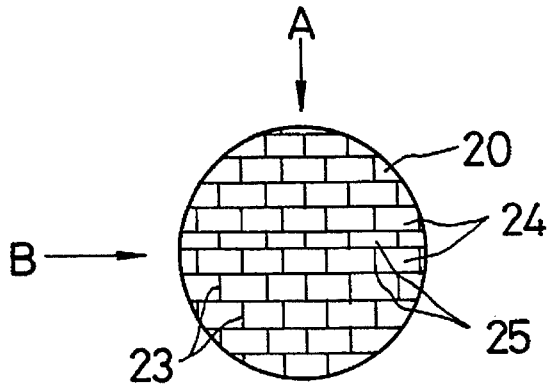
FIG. 10 is a cross sectional view of a base-ball bat produced according to FIG. 8.

According to the base-ball bat 20, in the case where a ball is batted back in an intersecting direction with respect to the direction of a laminated surface 25 (in the case where a flying ball in a direction of A is batted back), as shown in FIG. 10, the effects in hardness, batting feeling and batting sound are obtained similar to the case of the above-described golf head 5. In the case where a ball is batted back in a direction of a laminated surface 25 (in the case where a flying ball from a direction of B is batted back), the strength is increased by the hardness of the compressed and hardened laminated hide and by the action of the hardener and adhesives impregnated and solidified also in the slits 23, exhibiting the strength in excess of that in the direction of A.

From this, it can be understood that the balance in strength is excellent as compared with a conventional wooden bat which is strong in a direction of straight grain and weak in a direction of cross grain.

Figure 11:
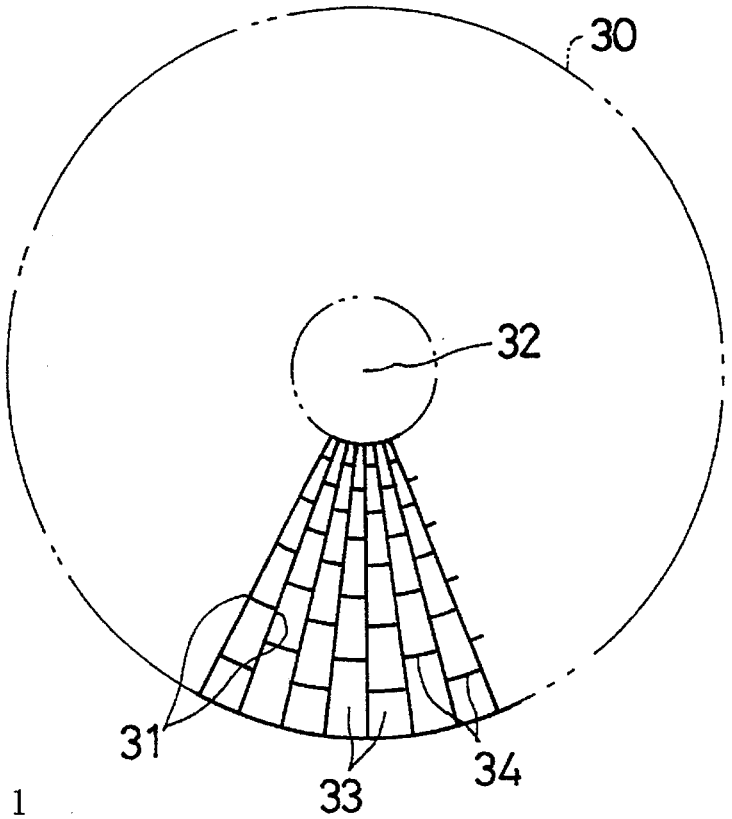
FIG. 11 is a cross sectional view of a base-ball bat according to another embodiment of the present invention.

FIG. 11 shows a base-ball bat 30 according to another configuration of the present invention.

In the base-ball bat 30, laminated end surfaces of a laminated hide 33 are arranged substantially radially from a center axis 32 of which external appearance is in the form of a bat.

The method for producing a base-ball bat 30 will be described. For example, a suitable number of hides 33 are suitably bonded by adhesvies or hardener about the center axis so that a direction of an adhesive surface 31 is radial about the center axis, preferably, slits 34 are parallel with the center axis. When this is profiled into a bat-like configuration with the center axis being the center axis 32 of a base-ball bat, the base-ball bat 30 can be produced.

According to the base-ball bat 30, the laminated end surfaces are formed to be directed at the whole area. Therefore, the hardness, batting feeling and batting sound superior to those of the above-described base-ball bat 20 are created, and in addition, the hardness and strength superior in balance to that of the above-described base-ball bat 20 can be exhibited.

In other sporting goods for batting such as a table-tennis racket, batting goods for cricket, sticks for hockey or ice hockey, though not shown, it is possible to produce sporting goods for batting in which a batting portion (in a golf club, mainly a head portion; in a base-ball bat, the entire body) is formed from a laminated hide similarly to the above to obtain similar effects.

Alternatively, at least a batting portion of the sporting goods for batting as described above may be formed by crushing hides into the form of chips or fibers, impregnating them with the hardener or adhesvies, and heating and pressing the same to have a desired shape.

According to the above method for production, the hides can be recycled. In addition, sporting goods having a batting surface of sufficient strength and hardness can be obtained.

As described above, according to the present invention, it is possible to produce sporting goods for batting having a batting portion formed of hides as a new material. Sporting goods for batting is produced from hides provided with slits to thereby enable the provision of sporting goods for batting which are excellent in elasticity, batting sound and batting feeling, which can absorb and attenuate batting stress and which is excellent in durability.

Moreover, the sporting goods can be light-weighted to render handling thereof easy.

I claim:

1. In a sporting implement having a head portion with a hitting surface for contacting a ball, the improvement comprising forming said head portion from laminate of a plurality of hide sections, each hide section having a plurality of slits therein.

2. The sporting implement of claim 1 wherein a longitudinal direction of said slits is generally parallel to said hitting surface.

3. The sporting implement of claim 1 wherein said head portion is a golf club head.

4. The sporting implement of claim 3 wherein a longitudinal direction of said slits is generally parallel to said hitting surface.

5. The sporting implement of claim 4 wherein said plurality of animal hide sections are inclined to a plane perpendicularly intersecting said hitting surface.

6. The sporting implement of claim 4 wherein said laminate is bent to form said golf club head and a golf club neck portion.

7. The sporting implement of claim 1 wherein said head portion further comprises a barrel portion of a baseball bat.

8. The sporting implement of claim 7 wherein a longitudinal direction of said slits is generally parallel to said hitting surface.

9. The sporting implement of claim 7 wherein said laminate is aligned with a longitudinal axis of said barrel portion.

10. The sporting implement of claim 7 wherein said plurality of animal hide sections are laminated so that slits of one animal hide section are misaligned with slits of an adjacent animal hide section.

11. The sporting implement of claim 7 wherein said laminate of said plurality of animal hide sections is arranged radially of an axis of said barrel portion so that end portions of the laminate form said hitting surface.

* * * * *